United States Patent [19]

Franzén et al.

[11] Patent Number: 4,655,411

[45] Date of Patent: Apr. 7, 1987

[54] MEANS FOR REDUCING SPREAD OF SHOTS IN A WEAPON SYSTEM

[75] Inventors: Arne Franzén; Kjell Albrektsson; Jan-Olov Fixell, all of Karlskoga, Sweden

[73] Assignee: AB Bofors, Bofors, Sweden

[21] Appl. No.: 680,340

[22] PCT Filed: Mar. 21, 1984

[86] PCT No.: PCT/SE84/00097

§ 371 Date: Nov. 26, 1984

§ 102(e) Date: Nov. 26, 1984

[87] PCT Pub. No.: WO84/03759

PCT Pub. Date: Sep. 27, 1984

[30] Foreign Application Priority Data

Mar. 25, 1983 [SE] Sweden ..... 8301651

[51] Int. Cl.[4] ..... F41G 7/00

[52] U.S. Cl. ..... 244/3.11; 89/41.07; 244/3.14

[58] Field of Search ..... 244/3.1, 3.11, 3.14; 89/41.07

[56] References Cited

U.S. PATENT DOCUMENTS

| | | | |
|---|---|---|---|
| 2,979,284 | 4/1961 | Genden et al. | 244/3.14 |
| 3,374,967 | 3/1968 | Plumley | 244/3.14 |
| 3,758,052 | 9/1973 | McAlexander et al. | 244/3.14 |
| 3,876,169 | 4/1975 | Fitzgerald et al. | 244/3.14 |
| 3,995,792 | 12/1976 | Otto et al. | 244/3.14 |
| 4,176,814 | 12/1979 | Albrektsson et al. | 244/3.15 |

*Primary Examiner*—Charles T. Jordan

*Attorney, Agent, or Firm*—Pollock, Vande Sande & Priddy

[57] ABSTRACT

The invention relates to means for reducing the spread of shots in a weapon system in which the shots are fired from the weapon in a ballistic trajectory from a launching device towards a target. It comprises means for measuring the position of the target, means for measuring the muzzle velocity of the ammunition unit, and, in one embodiment, also means for measuring the actual trajectory parameters of the ammunition unit (shell, projectile or the like), for instance the reduction of velocity in a specific trajectory distance. In response to these values the impact point is predicted. A braking command is transmitted to the ammunition unit via a radio line in response to the difference between the actual position of the target and the predicted impact point for braking the velocity of the ammunition unit in order to improve the hit probability. The braking means preferably comprises a plurality of braking flaps distributed about the periphery of the ammunition unit. Normally the braking flaps are retracted but they can be activated into a protruding position by an actuating device. Alternatively the desired braking effect can be obtained by separating different parts of the nose section from the body of the ammunition unit in order to increase its air-resistance.

8 Claims, 4 Drawing Figures

MEANS FOR REDUCING SPREAD OF SHOTS IN A WEAPON SYSTEM

BACKGROUND OF THE INVENTION

This invention relates to means for reducing the spread of shots in a weapon system in which the shots are fired from the weapon in a ballistic trajectory from a launching site towards a target and which comprises means for measuring target parameters and means for measuring the muzzle velocity of the shot.

Though it is now possible to more precisely determine the position of a target, and more sophisticated computers are used in the firing control equipment, there are, however, a number of factors which give rise to the spread of shots. As a result, the hit probability is rapidly reduced in proportion to the firing distance. In order to strike target a great number of shots are required, and also a considerable amount of time is required, which as a rule is not available in a duel fight.

For targets located within sight of the launching site, the hit probability can be increased by using guided projectiles or missiles, for instance a missle which is guided towards the target automatically or manually during the entire missile trajectory. Such systems are very complicated and therefore expensive. Specific missile launching devices are required and the target must be observed and followed by the operator.

In order to improve the hit probability and the effective firing range of, for instance, conventional antitank weaspon systems, efforts have recently been directed to terminally corrected projectiles. In such systems the projectiles are fired from conventional guns in a ballistic trajectory towards the target. In the vicinity of the target, a target detector is initiated to provide the required correction of the projectile in order to hit the target.

In order to achieve terminal correction, a target detector is then required which provides an error signal if the projectile is on its way to a point off target, and also a correction member for correcting the trajectory of the projectile in accordance with the error signal. The target detector can consist of, for instance, an IR-detector which, with a scanning lobe, senses the area around the target and, if the target is detected, transmits one or several guidance pulses to the correction member so that the trajectory of the projectile is changed and is directed towards the target.

A terminally corrected projectile of this type is previously known from Swedish Patent No. 76.03926-2, in which the correction member comprises a number of nozzles each connected with a respective detector and being actuable upon receipt of a signal from its respective detector.

Even if such a terminally corrected projectile, is less complicated and expensive compared with a guided missile, the projectile must be provided with rather complicated components such as the target detector and the correction member. Furthermore, a laser beam designator is required for illuminating the target. The reflected laser beam from the laser-illuminated target surface is detected by the target detector and, depending on the location of this reflected laser beam, a correction signal is provided by the detector to correct the ballistic trajectory.

SUMMARY OF THE INVENTION

It is an object of the present invention to provide means for reducing the spread of shots which is simpler than previously known terminally corrected projectiles.

A further object of this invention is to provide means which can be used against targets located at long firing ranges, for instance sea targets.

The invention is based on the fact that the spread of shots for conventional ammunition is approximately 5–6 times more in the firing direction than in the side direction. Therefore the hit probability can be improved mainly by reducing the spread of shots in the firing direction. Such spread of shots depends on the spread of muzzle velocity, projectile parameters such as mass and air-resistance coefficient, and the weather conditions. All these factors which contribute to the spread of shots are very difficult to predetermine. A certain spread of the muzzle velocity is unavoidable and often the most dominating contribution to the spread of shots in the firing direction, but also the air resistance of the ammunition unit and the specific weather conditions contribute since they cannot be absolutely predicted. Each ballistic trajectory of an ammunition unit is unique due to the influence of the surroundings and deficiencies of the projectile itself.

According to the present invention, there are means provided for calculating a predicted impact point based on at least the muzzle velocity, and braking means activatable in response to the difference between the actual target position and the predicted impact point for braking the velocity of the ammunition unit in order to increase the hit probability.

By increasing the muzzle velocity the nominal impact point can be located 1.0–1.5% beyond the target location. The ammunition unit is then corrected by braking its velocity in order to improve the hit probability. Depending on the location of the calculated impact point, a braking command of a certain level is transmitted to the ammunition unit. Consequently, the difference between the predicted and desired impact points can be reduced to a great extent so that the hit probability is then improved.

In preferred embodiment of the invention means can also be provided for measuring actual trajectory parameters such as the position and velocity of the ammunition unit in its trajectory, specifically the reduction of velocity within a predetermined trajectory distance. On the basis of these values the actual impact point can be calculated. The reduction of velocity is preferably determined during the first third of the trajectory.

A conventional launching device, for instance an artillery piece, can be used and the ammunition unit (projectile, shell or the like) can be provided with a conventional propulsion charge. It is necessary to provide the ammunition unit with a receiver but this receiver can be comparatively simple. The effectuating means in the ammunition unit for effectuating the required braking can also be relatively simple, for instance by protruding braking plates. The firing control equipment must be provided with means for measuring the muzzle velocity and, possibly also means for measuring actual ammunition unit trajectory parameters and calculating means which compares the actual trajectory with the desired trajectory.

In the following, the invention will be more fully described in connection with the accompanying drawings illustrating a preferred embodiment.

DESCRIPTION OF THE PREFERRED EMBODIMENTS

Figure 1:
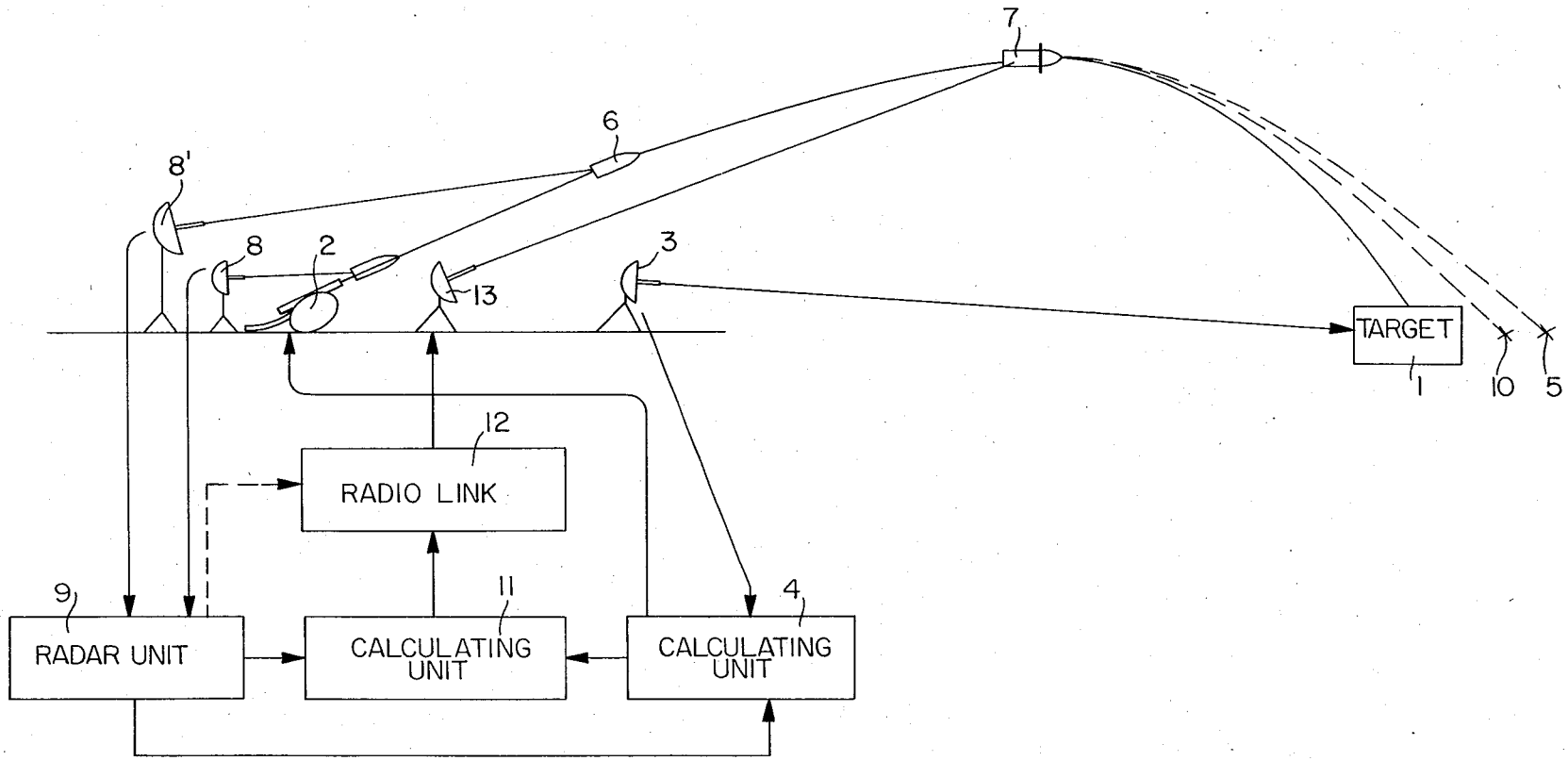
FIG. 1 is a schematic view of the invention.

FIG. 1 illustrates how the invention can be used in connection with an artillery system for combatting a target, for instance a ship. In the figure, target 1 indicates the actual position of the target or the set-forward point to which the weapon should be pointed in order to hit a moving target. As already mentioned the invention is characterized by a conventional launching device 2 in the form of an artillery piece or the like. The shells can have a caliber of, for instance, 7.5–15.5 cm.

By use of firing control radar means 3 the target position is continuously determined. This radar means comprises a calculating unit 4 for calculating the target parameters and predicting the target position. The calculating unit generates values for directing artillery piece 2 towards a point 5 which is located beyond the set-forward point, preferably 1.0–1.5% farther away from the set-forward point.

A shell fired from artillery piece 2 is illustrated in different positions 6, 7 in its trajectory towards point 5. A radar unit 8', 9 follows the shell in the initial phase of its trajectory and in response to the radar unit, the shell ballistics, and specifically, actual impact point 10, are calculated, which point, due to ambient conditions and deficiencies of the shell itself, deviates more or less from the predicted, ideal impact point 5.

A radar unit 8', 9 for measuring actual shell trajectory parameters is previously known per se and therefore is not described in detail here. Depending on the measurement, different parameters of the shell can be determined. In this example, the actual impact point is required and therefore the shell muzzle velocity is measured by means of a so-called $v_o$—velocity measuring equipment 8 located close to the piece 2. As already mentioned, the spread of $v_o$ (muzzle velocity) can be so dominating that it is sufficient to calculate the actual impact point 10 on the basis of only the measured muzzle velocity. In this case the radar unit 8', 9 is not required. In other cases, however, a correction is also desired for the spread of shots caused by variations of shell parameters such as mass, air-resistance coefficient and weather conditions, and then the radar unit 8', 9 is used for measuring the velocity reduction during, for instance, the first third of the shell trajectory.

Based on this calculated impact point 10 and the set-forward point 1, the required correction of the shell is calculated in order to place the impact point of the shell in the firing direction as close to the target point 1 as possible. If necessary, the corrected shell ballistics can be calculated and compared with the target point 1 for a new correction in the form of an iteration. At a specific time when the shell has reached the position 7 in its trajectory, a command signal is sent via a radio link 12, 13 to a receiver in the shell. A control unit in the shell provides for the release of a certain number of braking flaps to make the shell follow a corrected trajectory to hit the target 1. The control unit and the braking flaps are described more in detail in connection with FIGS. 2, 3 and 4.

Depending on the difference between the predicted, calculated impact point 10 and the target point 1, different braking levels are introduced. If for instance a three level braking is used, this means that shells having a predicted impact point in the interval A beyond the target point 1 are corrected by braking level 1, shells having an impact point in the interval B beyond A are corrected by braking level 2, and shells having an impact point in the interval C, beyond B, are corrected by braking level 3. The braking level 1, for instance, means that the air resistance is increased by 10% after 0.3 of the trajectory time and a corresponding increase for the other braking levels.

The example illustrated in FIG. 1 relates to an artillery system in which a shell is fired towards a moving target. The invention can be used, however, in connection with all types of ammunition units which are fired in a ballistic trajectory towards a target, for instance projectiles, rockets, bombs and mines. Therefore the artillery piece 2 in FIG. 1 only illustrates the initial trajectory point. The radar units 3 and 8, the calculating units 4, 9 and 11 and the radio link 12, 13 are previously known per se. Instead of a radio link 12, 13, other signalling means can be used, for instance optical or infrared signals, to provide the fired ammunition unit with the braking command. Also human operators and mechanical devices can replace parts of the system. The units can also be divided into a number of smaller, even more specialized, parts. As an alternative, more functions can be combined in each unit. Furthermore the firing control equipment, of course, can be located in some other place instead of at the launching site.

Figure 2:
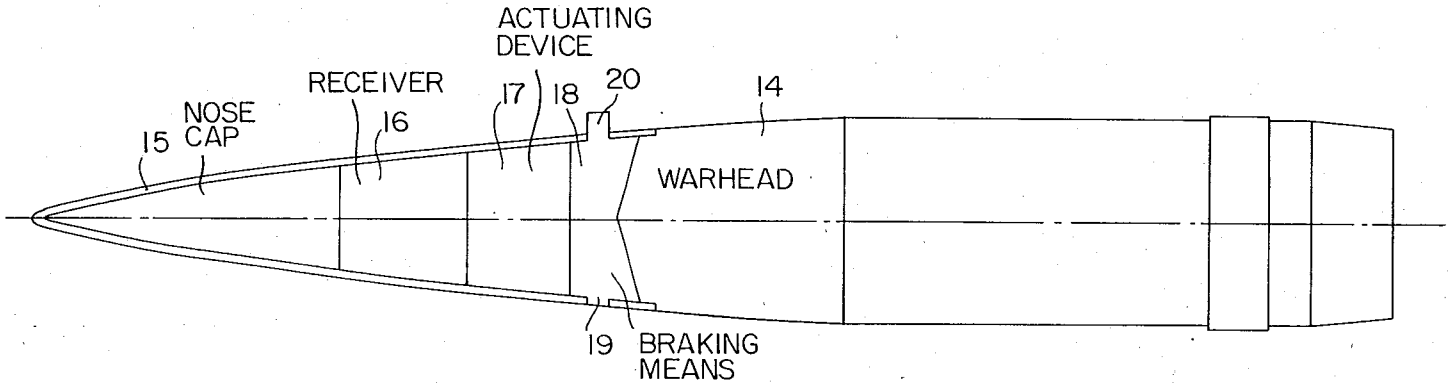
FIG. 2 is a specific example.

FIG. 2 illustrates a shell according to the invention; in this case a conventional high-explosive shell with a warhead 14 and a nose cap 15. The nose cap, however, is provided with a receiver 16 arranged to receive the braking command from radio link 12, 13, an actuating device 17 and braking means 18 provided with a plurality of braking flaps 19 distributed about the periphery of the shell, one of the braking flaps 20 being shown in its protruding position.

Figure 3:
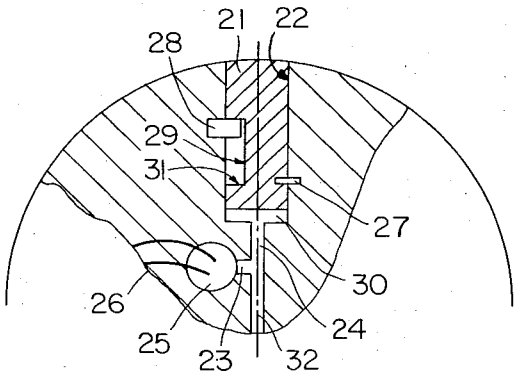
FIGS. 3 and 4 are two examples of braking means which can be used.

FIG. 3 is an enlarged view of the braking means 18 with a braking flap 21 in its retracted position. The braking flap 21 is disposed in a recess 22 which is connected, via channels 23, 24, with an electric igniter 25. The electric igniter is connected, via an electric wire 26, to actuating device 17 and arranged to initiate a powder charge. The braking flap is fixed in its retracted position by means of a shear pin 27. The recess wall is provided with stop pin 28 engaging a corresponding recess 29 in the braking flap so that its extension outside the shell body is limited.

Figure 4:
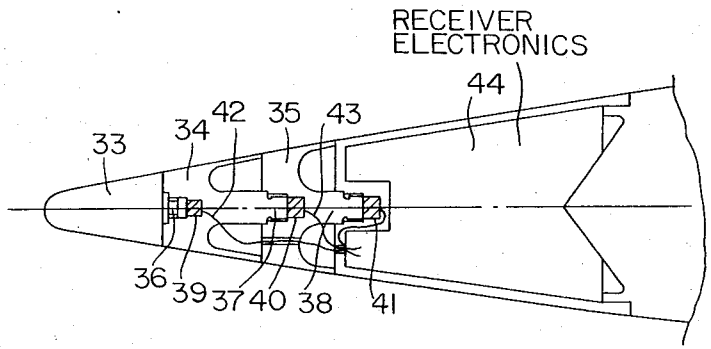

FIG. 4 illustrates a further embodiment of the invention in which the required braking correction is established by separating different parts of the nose section from the shell body in order to increase the air resistance. FIG. 4 illustrates three such separate nose parts 33, 34 and 35, each part attached to the rest of the shell body by means of screw threads 36, 37 and 38. A small powder charge 39, 40 and 41 in the form of a detonator cap or the like is disposed in association with each part and connected via electrical wires 42, 43 to the receiver electronics 44. In order to facilitate the separation of the parts from the shell body they can be eccentric.

By throwing away one or more parts 33, 34, 35 different braking effects can be obtained. As an alternative, a single braking device can be included in the shell and then different braking effects can be obtained by activating the powder charge at a specific time. A so-called delay stage can be included in the receiver electronics 44 or in the ground equipment.

The invention operates in the following way. If the predicted impact point 10, calculated by the radar unit 8', 9, differs from target position 1, a braking command is sent to receiver 16 of the shell via radio link 12, 13. The braking command is then sent to actuating device 17 which, dependent of the level of the braking command, activates the specific braking flaps required for the desired braking. For activating the braking flaps the electric igniter is initiated via an igniting pulse on conductive wire 26 so that a powder charge is initiated. The gases of the powder charge are fed to recess 22 through channels 23, 24 and pressure chamber 30 under braking flap 21. Under the influence of the powder gases in pressure chamber 30, shear pin 27 is broken and the braking flap is pushed out by the gases so that stop pin 28 engages wall 31 of the recess to stop the movement. Braking flap 21 is then maintained in this position by stop pin 28, and the centrifugal force due to the rotation of the shell, even after the powder gases have leaked out.

The extending portion of the braking flap is adapted to fulfil the requirements of a specific braking effect, aerodynamics and stability. If appropriate, more than one braking flap can be activated by the same powder charge, as indicated in figure by the channel 32, for instance for releasing a symmetrically arranged braking flap.

The braking device of FIG. 4 operates essentially in the same way. A braking command is sent to the receiver electronics 44 of the ammunition unit. Depending on the level of the braking command one or more powder charges 39, 40, 41 are activated, or alternatively an appropriate delay. After the nose section(s) have been separated, the air resistance is considerably increased which means a substantial braking effect.

The invention is not limited to the above example but can be varied within the scope of the following claims.

We claim:

1. Means for reducing the spread of shots in a weapon system in which the shots are fired from a weapon in a ballistic trajectory from a launching site towards a target comprising means for determining the target position, means for measuring the muzzle velocity of an ammunition unit in response to which the impact point of said ammunition unit is predicted, and drag means for affecting change in the aerodynamic shape of said ammunition unit activated in response to the difference between the actual position of the target and the predicted impact point for braking the velocity of said ammunition unit in order to improve the hit probability, said drag means being normally in a first unactivated state in which the air resistance of said ammunition unit is not affected; said drag means being adapted to be brought to a second state defining at least one predetermined braking level; and an actuating device for providing a required pressure to bring said drag means from said first to said second state; wherein said activating device comprises a powder charge.

2. Means according to claim 1 wherein said muzzle velocity measuring means comprises means for measuring the actual trajectory parameters of said ammunition unit, for instance reduction of velocity within a predetermined trajectory distance, and wherein said predicted impact point is based also on this measurement.

3. Means according to claim 2 wherein drag means for braking the velocity of the ammunition unit are activated by sending a braking command from the launching site, via radio, to a receiver in said ammunition unit.

4. Means according to claim 3 further comprising a calculating unit for calculating the required braking command for the predicted impact point to coincide with the actual target position whereupon a corresponding braking command is transmitted to said ammunition unit in a predetermined position of its trajectory.

5. Means according to claim 4 wherein said drag means comprises a plurality of braking flaps distributed about the periphery of said ammunition unit in said first unactivated state being retracted in recesses and pushed out into said second protruding state by said actuating device whereby the protruding parts provide the desired braking effect.

6. Means according to claim 6 wherein said actuating device further comprises at least one electric igniter for initiating said powder charge and wherein powder gases are arranged via channels to provide the required pressure in a pressure chamber behind the braking flaps for moving them into said second protruding state.

7. Means according to claim 4 wherein said receiver in response to the braking command is arranged to separate one or more parts from the nose section in order to increase the air-resistance of the ammunition unit in said second state.

8. Means according to claim 7 wherein said parts are separated by means of powder charges disposed in association with attaching means.

* * * * *